US010829333B2

(12) United States Patent
Kubo

(10) Patent No.: US 10,829,333 B2
(45) Date of Patent: Nov. 10, 2020

(54) IMAGE FORMING SYSTEM

(71) Applicant: Mamoru Kubo, Yamanashi-ken (JP)

(72) Inventor: Mamoru Kubo, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 77 days.

(21) Appl. No.: 16/232,408

(22) Filed: Dec. 26, 2018

(65) Prior Publication Data

US 2019/0193425 A1 Jun. 27, 2019

(30) Foreign Application Priority Data

Dec. 27, 2017 (JP) ..... 2017-250294

(51) Int. Cl.
*B65H 29/12* (2006.01)
*B41J 11/00* (2006.01)
*B41J 29/38* (2006.01)

(52) U.S. Cl.
CPC ..... *B65H 29/125* (2013.01); *B41J 11/002* (2013.01); *B41J 11/007* (2013.01); *B41J 29/38* (2013.01); *B65H 2301/33312* (2013.01)

(58) Field of Classification Search
CPC ..... B65H 2801/48; B65H 2405/332; B65H 2801/24; B65H 2801/27; B65H 2301/517; B65H 2801/06; B65H 2301/516; B65H 2301/5161; B65H 2301/51611; B65H 29/00; B65H 29/14; B41J 11/002; G03G 15/6538; G03G 15/6532
See application file for complete search history.

(56) References Cited

U.S. PATENT DOCUMENTS

2008/0185764 A1* 8/2008 Dobashi ..... G03G 15/6582 270/37
2011/0150550 A1* 6/2011 Wakabayashi ..... B65H 29/60 399/407

FOREIGN PATENT DOCUMENTS

JP 2017-132636 A 8/2017

* cited by examiner

*Primary Examiner* — Jeremy R Severson
(74) *Attorney, Agent, or Firm* — Manabu Kanesaka

(57) ABSTRACT

Disclosed herein is an image forming system enabling size reduction of apparatus. In the system, a sheet drying unit and a sheet post-processing unit are arranged, respectively above and below a sheet holding section to which sheets are ejected from an image forming apparatus A. Further, a relay transporting unit is provided, which is configured to transport a sheet from the sheet drying unit to a sheet post-processing unit. The relay transporting unit is formed, surrounding the sheet holding section.

14 Claims, 6 Drawing Sheets

IMAGE FORMING SYSTEM

1. FIELD OF THE INVENTION

This invention relates to an image forming system, for example, an ink-jet printer, which is configured to print data on media, such as sheets being transported.

2. DESCRIPTION OF THE RELATED ART

Hitherto known well is an image forming system that forms images on sheets (i.e., media) and performs processes, such as drying process and stapling process, on the sheets having the images formed (see, for example, Patent Document 1). In this image forming system, an intermediate device (e.g., drying-reversing unit) is provided at one side of the image forming apparatus. Further, a post-processing apparatus is arranged, opposing the intermediate device, at the opposite side of the image forming apparatus. Still further, an ejecting section for ejecting the sheet is provided at the side of the post-processing apparatus (namely, the side opposing the intermediate device).

PRIOR ART DOCUMENT

Patent Document

[Patent Document 1] Japanese Patent Application Publication No. 2017-132636

SUMMARY OF THE INVENTION

In the conventional apparatus disclosed in Patent Document 1, all units are arranged side by side, inevitably increasing the installation area of the apparatus. The present invention has been made in view of this problems with the prior art, and aims to reduce the installation area of the apparatus by arranging the units efficiently.

An image forming system according to this invention has been made to achieve the object mentioned above. The image forming system comprises: an image forming unit configured to perform an image forming process on a medium; a medium ejecting section having a holding part onto which the medium having an image formed in the image forming unit may be ejected; a first process unit provided below the holding part and configured to perform a prescribed process on the medium; and a second process unit provided above the holding part and configured to perform a prescribed process on the medium.

In the image forming system according to the present invention, the units are efficiently arranged, and the installation area of the units can be decreased.

DETAILED DESCRIPTION OF THE EMBODIMENTS

Figure 1:
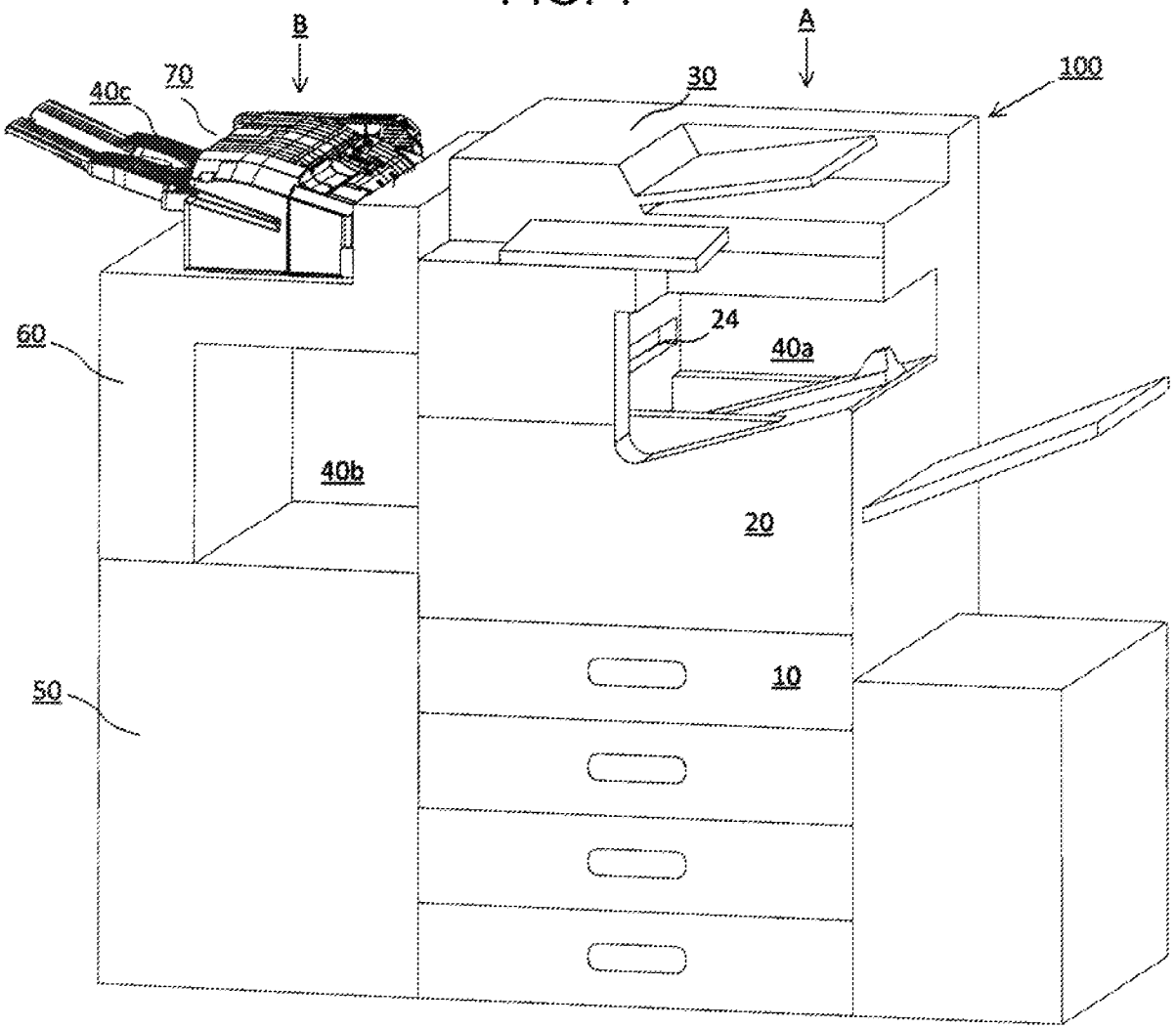
FIG. 1 is a perspective view showing the overall configuration of the image forming system according to an embodiment of the invention.

Preferred embodiments of this invention will be described below, with reference to the accompanying drawings. Any components identical or similar will be designated by the same reference numeral in the drawing and in the entire specification.

Figure 2:
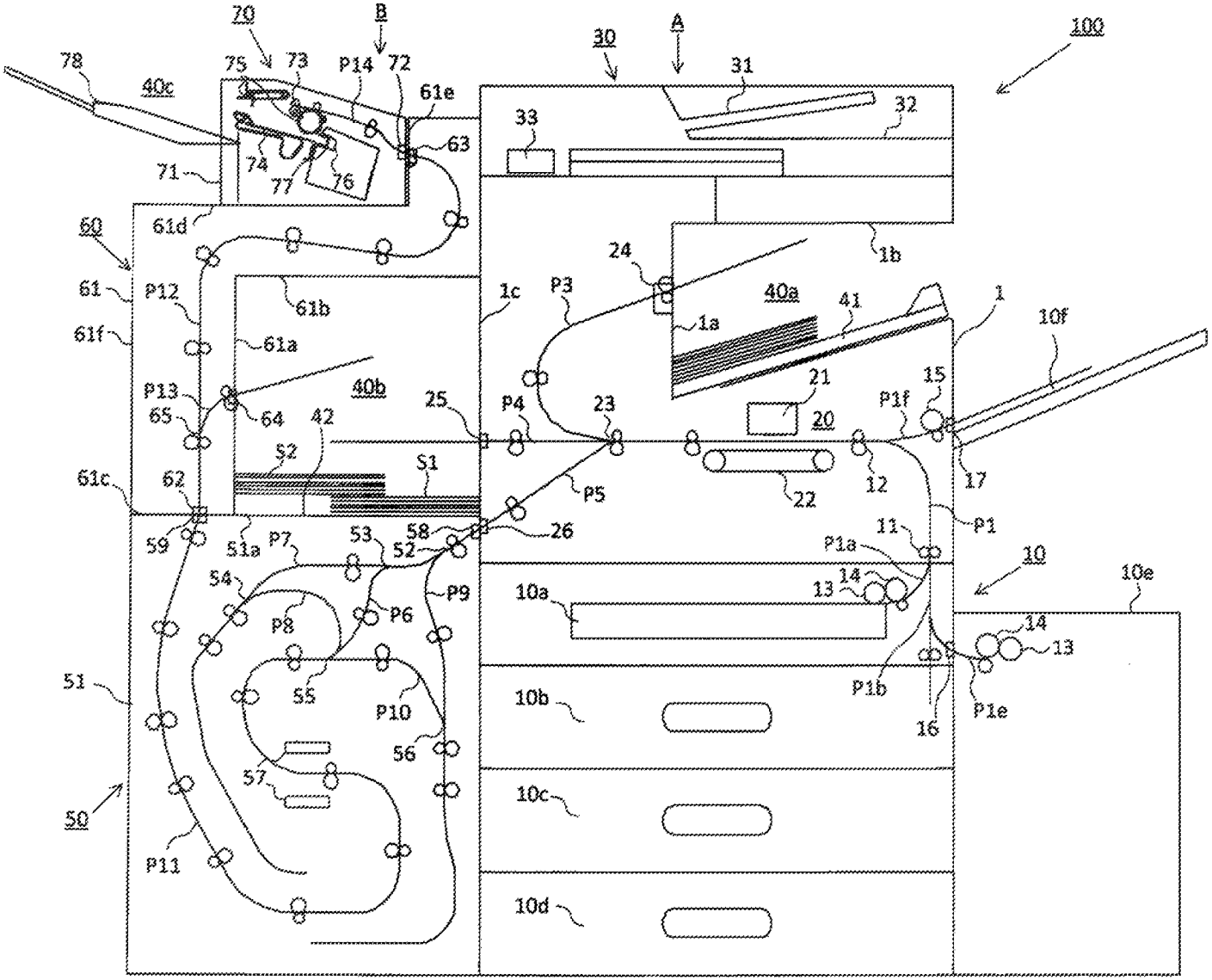
FIG. 2 is a sectional view showing the overall configuration of the image forming system according to the embodiment.

FIG. 1 and FIG. 2 schematically show the overall configuration of the image forming system according this invention, which comprises a sheet processing apparatus. As FIG. 1 and FIG. 2 show, the image forming system 100 comprises an image forming apparatus A and a sheet processing apparatus B. The image forming apparatus A is composed of a sheet supplying unit 10, an image forming unit 20, and an image reading unit 30. The sheet processing apparatus B is composed of a sheet drying unit (sheet reversing unit) 50, a relay transporting unit 60, and a sheet post-processing unit 70.

<Sheet Supplying Unit>

The sheet supplying unit 10 is provided at a lower side of the image forming apparatus A. The sheet supplying unit 10 is composed of a plurality of cassette mechanisms 10*a*, 10*b*, 10*c* and 10*d* configured to store image forming sheets of different sizes, respectively, and is configured to supply a sheet of the size designated by the control section (not shown) into a sheet supplying path P1. The cassette mechanisms 10*a*, 10*b*, 10*c* and 10*d* are arranged, detachably from the sheet supplying unit 10. Each cassette mechanism incorporates a separating mechanism for separating one sheet from another sheet, and a feeding mechanism for feeding the sheet so separated.

To the sheet supplying path P1, a large-storage cassette 10*e* and a hand-feeding tray 10*f* are connected. The large-storage cassette 10*e* and the hand-feeding tray 10*f* are arranged at one side of the housing 1 of the image forming apparatus (namely, at the right side in FIG. 1). The housing 1 has sheet supplying ports (i.e., sheet-supplying openings) 16 and 17 which are associated with the large-storage cassette 10*e* and the hand-feeding tray 10*f*, respectively. The large-storage cassette 10*e* is an optional unit for holding sheets of a specific size, which are consumed in large quantities. The hand-feeding tray 10*f* is configured to hold special sheets such as thick sheets, coated sheets or film sheets, which cannot be supplied, each isolated from another.

In the sheet supplying path P1, there are provided a pair of supply rollers 11 for supplying sheets from the cassette mechanisms 10*a*, 10*b*, 10*c* and 10*d* to the downstream side (through the sheet paths P1*a* and P1*e*). At the end of the sheet supplying path P1, a pair of registering rollers 12 is provided to align sheets at their leading ends.

In each of the cassette mechanisms 10*a*, 10*b*, 10*c* and 10*d* and in the large-storage cassette 10*e*, there are provided a pickup roller 13 and a pair of supply rollers 14. The pickup roller 13 and the pair of supply rollers 14 supply the sheets, one by one, to the sheet supplying path P1. In the housing 1 of the image forming apparatus A, a pair of supply rollers 15 is provided in the vicinity of the sheet supplying port 17 of the hand-feeding tray 10*f*. The supply rollers 15 supply any sheet hand-fed by the user, toward the pair of registering rollers 12.

<Image Forming Unit>

The image forming unit 20 is provided at a sheet transport path P2, in the upper part of the cassette mechanisms 10*a*, and comprises a printing section of, for example, ink-jet type. The image forming unit 20 has an image forming section 21, which is positioned, opposing a transport belt 22 across the sheet transport path P2. The image forming section 21 ejects liquid, e.g. ink, to the sheet being transported along the sheet transport path P2 and being supported by the transport belt 22, thereby printing data on the sheet. The image forming section 21 of this embodiment is constituted by a line head that can eject ink droplets to the sheet simultaneously along a line extending in the widthwise direction that intersects (at right angles) with the sheet transport direction.

The image forming section according to this application is not limited to an ink-jet type. The image forming section may be, for example, an electrostatic printing mechanism comprising a rotatable photosensitive drum and a light-beam emitting device, a developer and a cleaner which are arranged around the rotatable photosensitive drum. In this case, the light-beam emitting device optically forms a latent image on the photosensitive drum, and the developer applies toner to the latent image. At the time of forming the image on the photosensitive drum, a sheet is transported to the sheet transport path P2. A transfer charger transfers the image onto the sheet, and the image so transferred is fixed by the fixing rollers which are arranged downstream in the sheet transport direction.

The sheet now having an image formed on it is supplied to a first sheet-ejecting section 40*a*, a second sheet-ejecting section 40*b*, or a sheet drying unit (i.e., sheet reversing unit) 50. A path switching section 23 is provided, which has a flapper guide (not shown). The flapper guide is moved in accordance with the destination of the sheet, and guides the sheet to one of transport paths P3, P4 and P5.

To deliver the sheet to the first sheet-ejecting section 40*a*, the path switching section 23 transfers the sheet from the sheet transport path P2 to the transport path P3. Then, the sheet is ejected onto a sheet holding surface (sheet holding section) 41 in the face-down state, with its printed side facing downwards. The transport path P3 curves upward (as if it drew an arc) from the substantially horizontal sheet transport path P2, starting at the path switching section 23. The transport path P3 is shaped, further extending toward the sheet ejecting port 24 (provided in the housing 1 of the image forming apparatus).

To transport the sheet to the second sheet-ejecting section 40*b*, the path switching section 23 transfers the sheet from the sheet transport path P2 to the transport path P4. In this case, the sheet is ejected onto a sheet holding surface (sheet holding section) 42 in the face-up state, namely having its printed side facing upwards. The transport path P4 is provided above the substantially horizontal sheet transport path P2, and extends from the path switching section 23 to the sheet ejecting port 25 (made in the housing 1 of the image forming apparatus).

To transport the sheet to the sheet drying unit 50, the path switching section 23 transfers the sheet from the sheet transport path P2 to the transport path P3. The sheet is then transported to the sheet drying unit 50. The transport path P5 is provided below the transport path P4 and extends from the path switching section 23 toward a sheet ejecting port 26 (provided in the housing 1 of the image forming apparatus).

The image forming apparatus A has a reversing path (not shown). In the reversing path, the sheet is turned upside down after an image has been formed on the upper side, so that an image may then be formed on the lower side of the sheet. The reversing path may not be provided in the image forming apparatus A. If this is the case, the sheet drying unit (sheet reversing unit) 50, which will be described later, may turn the sheet upside down, and the sheet may then be transported again to the image forming unit 20.

<Image Reading Unit>

The image reading unit 30 is provided above the first sheet-ejecting section 40*a* and the transport path P3. The image reading unit 30 is composed of an image reading section 33 for reading the image formed on an original, an original-sheet tray 31 for holding the original, and an ejected-original tray 32 for ejecting the original from which the image has been read by the image reading section 33. The image reading unit 30 performs photoelectric conversion, changing the image to image data, and outputs an electric signal representing the image data to the image forming unit 20. Alternatively, a platen holding the original, a carriage able to move back and forth along the platen, and the image reading section 33 mounted on the carriage may be used to read the image from the original.

<Sheet Drying Unit (Sheet Reversing Unit)>

At the sheet ejecting port 26, namely the end of the transport path P5, the sheet drying unit (sheet reversing unit) 50 is provided and functions as first processing section. The sheet drying unit 50 is arranged, opposing the large-storage cassette 10*e* across the image forming apparatus A. The sheet drying unit 50 has a unit housing 51 and comprises a plurality of transport paths P6 to P11 (each having a pair of transport rollers), a plurality of path switching units 52 to 56, and fans 57, which are all provided in the unit housing 51.

The unit housing 51 has a sheet supplying port 58 associated with the sheet ejecting port 26 of the image forming apparatus A. Through the sheet ejecting port 26 and the sheet supplying port 58, the sheet is transferred from the transport path P5 to the transport path P6. The transport path P6 extends from the sheet supplying port 58 to a path switching unit 55 and passes through the path switching units 52 and 53. The transport path P11 is provided downstream the path switching unit 55, as viewed in the sheet-transporting direction. The transport path P11 extends toward a sheet ejecting section 59 which is provided on the upper surface of the unit housing 51.

Transport paths P7 and P9 are provided downstream the path switching unit 52, in addition to the transport path P6. The transport path P7 and the transport path P9 are transport paths for turning the sheet upside down, and are identical in function. Owing to these two transport paths, the odd-numbered sheets can be sorted to the transport path P7 and the even-numbered sheets can be sorted to the transport path P9. This can increases the efficiency of processing sheets. If only one sheet reversing path needs be used, only one path, either path P7 or path P9, may be provided.

The transport path P7 is branched from the transport path P6 by the path switching unit 53, and extends downstream from a path switching unit 54, for a distance longer than the length of the largest sheet (i.e., length measured in the sheet-transporting direction). Between the path switching unit 54 and the path switching unit 55, a transport path P8 is provided, in which the sheet turned upside down is transported. More specifically, when the trailing end of the sheet (i.e., upstream end of the sheet being transported in the transport path P7) passes the path switching unit 54, the flapper guide (not shown) of the path switching unit 54 is moved, thereby switching back the sheet and guiding the trailing end of the sheet into the transport path P8. Then, the sheet, still turned upside down, is transported toward the transport path P11.

The transport path P9 is branched from the transport path P6 by the path switching unit 52, and then extends downstream from the switching unit 56, for a distance longer than the maximum sheet size (i.e., sheet length measured in the sheet-transporting direction). Between the path switching unit 56 and the path switching unit 55, a transport path P10 is provided. Through the transport path P10, the sheet turned upside down is transported. More specifically, when the trailing end of the sheet (i.e., upstream end of the sheet being transported in the transport path P9) passes the path switching unit 56, the flapper guide (not shown) of the path switching unit 56 is moved, switching back the sheet and guiding the trailing end of the sheet into the transport path P10. The sheet turned upside down is thereby transported toward the transport path P11.

Therefore, the sheet received from the image forming apparatus A may be ejected without being turned upside down. In this case, the sheet is transported from the transport path P6 toward the transport path P11. In order to eject the sheet turned upside down, the path switching unit 52 switches the transport path to the transport path P7 or to the transport path P9. Then, the sheet is turned upside down and transported toward the transport path P11.

In the sheet drying unit 50, the fans 57 are provided at positions along the transport path P11. Since the image forming unit 20 of this embodiment is an ink-jet type configured to form images on a sheet, the fans 57 dry the sheet if the sheet must be ejected after the ink applied to it has been dried. Even if the fans 57 are not provided, the sheet can be dried well. This is because the sheet is transported for a longer time after it passes the sheet drying unit (sheet reversing unit) 50 until it reaches the second sheet-ejecting section 40*b*, than in the case where it is transported directly to the first sheet-ejecting section 40*a* or the second sheet-ejecting section 40*b* after an image is formed on it.

The upper surface 51*a* of the unit housing 51 of the sheet drying unit 50 constitutes the sheet holding surface 42 of the second sheet-ejecting section 40*b*. The second sheet-ejecting section 40*b* defines a space defined by the sheet holding surface 42 and the unit housing 61 of the relay transporting unit 60, which will be described below.

<Relay Transporting Unit>

The relay transporting unit 60 is a unit configured to transport the sheet from the sheet drying unit 50 to either the second sheet-ejecting section 40*b* or the post-processing unit 70 (later described). The housing 61 and transport path P12 of the relay transporting unit 60 are crank-shaped (that is, shaped like inverted S), and extend from a sheet supplying port 62 to a sheet ejecting port 63. The relay transporting unit 60 has a transport path P13. The transport path P13 is branched from the transport path P12 by a path switching section 65. The transport path P13 is a transport path for transporting the sheet from a sheet ejecting port 64 (made in the vertical face 61*a* of the unit housing 61) to the second sheet-ejecting section 40*b*.

As shown in FIG. 2, the sheet transport path P12 extends upward (toward the post-processing unit 70 described later) from the sheet supplying port 62 (through which the sheet may be received from the sheet drying unit 50). The sheet transport path P12 bends to the image forming apparatus A (to the right as shown in FIG. 2 at the part lying above the ceiling 61*b* of the unit housing 61, and bends again upward in front of the vertical face 1*c* of the image forming apparatus A. The sheet transport path P12 then extends to the sheet ejecting port 63 (i.e., sheet receiving port of the post-processing unit 70, which is provided on the vertical face 61*e* of the unit housing 61), which faces the image forming apparatus A. The unit housing 61 and the transport path P12 (i.e., relay transport path) are arranged, surrounding the second sheet-ejecting section 40*b* (i.e., sheet holding surface 42).

<Post-Processing Unit>

The post-processing unit 70 is a unit configured to perform post process such as the process of stapling the sheets received from the relay transporting unit 60. In this embodiment, the post-processing unit 70 has a sheet stapling mechanism which first aligns the sheets transported to it and then staples the sheets together, forming a sheet bundle.

The post-processing unit 70 comprises a sheet supplying port 72, a transport path P14, a sheet ejecting section 73, a process tray 74, a sheet receiving member 75, a stapling section 76, and a sheet-end aligning member 77, which are all incorporated in a unit housing 71. The sheet post-processing unit 70 further comprises a stack tray 78, which opposes the sheet supplying port 72 and can move up and down.

The post-processing unit 70 is mounted on the upper surface 61*d* of the unit housing 61 of the relay transporting unit 60. The vertical side 71*a* of the unit housing 71, which faces the image forming apparatus A, corresponds to the vertical side 61*e* of the relay transporting unit 60.

In the post-processing unit 70 of this embodiment, the sheet supplying port 72 receives the sheet transported from the sheet ejecting port 63 of the relay transporting unit 60. The sheet is transported along the transport path P12 and ejected by the sheet ejecting section 73 onto the process tray 74. The sheet receiving member 75 transports the sheet back until the trailing end of the sheet (i.e., the end upstream in the direction the sheet has been rejected) abuts on the sheet-end aligning member 77. Having its trailing end abutting on the sheet-end aligning member 77, the sheet has its sides aligned with those of any other sheet mounted on the process tray 74 (in the direction intersecting at right angles with the sheet-transporting direction), by means of the widthwise adjusting members (not shown).

The process sequence, from the sheet transporting to the widthwise adjusting, is repeated several times. When the number of the sheets mounted on the process tray 74 reaches a prescribed value, the stapling section 76 staples the sheets together, forming a sheet bundle. Then, the sheet-end aligning member 77 is moved to the stack tray 78, whereby the sheet bundle is ejected onto the stack tray 78, which is a third sheet-ejecting section 40*c*.

The mechanism and function of the post-processing unit 70 are described in, for example, JP 2015-16970A. Various post-processing units can be used to perform not only needle stapling, but also various post-processes such as non-needle stapling, sheet punching and sheet folding. Further, the sheets can be shifted in the widthwise direction (i.e., the direction intersecting the sheet-transporting direction) without going through the stapling process, and can then be ejected onto the stack tray 78. This sheet processing can be included in the post-processes. The sheets can be shifted in the widthwise direction, either by changing the position where they are aligned by the widthwise adjusting members provided on the process tray 74, or by changing the position where they are ejected, by using a mechanism that shifts the pair of exit rollers of the sheet ejecting section 73.

<Sheet Ejecting Sections>

This embodiment has a plurality of sheet ejecting sections configured to eject the processed sheets. As described above, the first sheet-ejecting section 40*a* is a section for ejecting any sheet processed in the image forming unit 20, in face-down state. The first sheet-ejecting section 40*a* is an "incorporated sheet-ejecting section" of the image forming apparatus A, and is a space defined by the vertical face 1*a* and ceiling 1*b* of the housing 1, and sheet holding surface 41.

The second sheet-ejecting section 40*b* is configured to straightly eject, through the sheet ejecting port 25, any sheet having an image formed by the image forming unit 20, in face-up state, or is configured to eject, through the sheet ejecting port 64 of the relay transporting unit 60, any sheet dried by the sheet drying unit 50. If the sheet dried in the sheet drying unit 50 should be transported, in face-up state, to the second sheet-ejecting section 40*b*, the sheet is turned upside down by using the transport path P7 or the transport path P9 and is then ejected. To transport the sheet, in face-down state, to the second sheet-ejecting section 40*b*, the transport path P6 is used, not turning the sheet at all.

The sheet can be transported to the second sheet-ejecting section 40*b* from both the sheet ejecting port 25 and the sheet ejecting port 64. Hence, the sheet to be ejected onto the sheet holding surface 42 can be shifted in the direction in which the sheet is transported until it is ejected. To shift and eject, for example, a five-sheet bundle, the five sheets are first ejected from the sheet ejecting port 25 and are then from the sheet ejecting port 64. The sheet bundle can be so shifted, without separately providing a mechanism for shifting the sheets.

To transport the sheet, in face-up state, to the second sheet-ejecting section 40*b*, the sheet can be delivered from the sheet ejecting port 25 if the sheet need not be dried. To transport the sheet after drying the sheet, the sheet can be turned upside down while it is being dried in the sheet drying unit 50 and can then be delivered from the sheet ejecting port 64. To be transported in face-down state, the sheet may be delivered to the first sheet-ejecting section 40*a* if it need not be dried. To be transported after it has been dried, the sheet can be first dried in the sheet drying unit 50 without being turned upside down and can then be delivered through the sheet ejecting port 64 to the second sheet-ejecting section 40*b*.

The sheet can be delivered through the sheet ejecting port 24 or the sheet ejecting port 64 in accordance with the amount of ink applied to the sheet during the image forming process performed in the image forming unit 20. If the character-printing ratio is low, for example, the ink applied to the sheet need not be dried, and the sheet may therefore be delivered through the sheet ejecting port 25 after an image has been formed on it. If the character-printing ratio is high, the ink applied to the sheet must be dried, and the sheet may therefore be delivered from the sheet ejecting port 64 to the second sheet-ejecting section 40*b* through the sheet drying unit 50. In this case, the user may select the sheet ejecting port 25 or the sheet ejecting 64, or a first control CPU 81 may calculate the character-printing ratio for the image forming process performed in the image forming unit 20 and compare the ratio with a prescribed threshold value, thereby to select the sheet ejecting port 25 or the sheet ejecting 64.

The second sheet-ejecting section 40*b* is a space that is defined by the vertical face 1*c* of the housing 1 of the image forming apparatus A, which faces the relay transporting unit 60, the upper surface (i.e., sheet holding surface 42) of the unit housing 51 of the sheet drying unit 50, the vertical face 61*a* of the unit housing 61 of the relay transporting unit 60, which opposes the image forming apparatus A, and the ceiling 61*b* of the unit housing 61.

The sheet supplying port 62 (and a part of the transport path P12) is positioned, opposing the image forming apparatus A with respect to the second sheet-ejecting section 40*b*. The sheet can therefore be transported to the second sheet-ejecting section 40*b*, either from the image forming apparatus A directly through the sheet ejecting port 25 or from the relay transporting unit 60 through the sheet ejecting port 64.

The size of the sheet holding surface 42 (i.e., length measured in the sheet-transporting direction) is set longer than the length of the sheet delivered to the second sheet-ejecting section 40*b* (i.e., minimum sheet length measured in the sheet-transporting direction). In other words, the space between the vertical face 1*c* of the image forming apparatus A and the vertical face 61*a* of the unit housing 61 is longer than the sheet delivered to the second sheet-ejecting section 40*b*. Note that the sheet holding surface 42 and the lower surface 61*c* of the relay transporting unit are set well within the width of the upper surface 51*a* of the unit housing 51 of the sheet drying unit 50. Therefore, the size of the apparatus (as measured in the width direction) can be small.

The stack tray 78 of the sheet post-processing unit 70 functions as third sheet-ejecting section 40*c*, to which the sheet is delivered after it has been post-processed in the sheet post-processing unit 70. The stack tray 78 can move (up and down) between the two positions indicated by solid and broken lines in the drawing. The stack tray 78 moves up and down in accordance with the number of sheets it holds. The sheet post-processing unit 70 of this embodiment has a mechanism for shifting the sheet in the widthwise direction. Therefore, without going through the stapling process, the sheet can be delivered onto the stack tray 78 as it is shifted in the widthwise direction on the stack tray 78. The sheet can be delivered onto the second sheet-ejecting section 40*b*, too. However, the sheet so shifted does not pass through the sheet drying unit 50, and is therefore delivered to the third sheet-ejecting section 40*c* by means of the shifting mechanism incorporated in the sheet post-processing unit 70. Hence, any sheet that has been dried can be shifted and then ejected.

<Arrangement of the Units of Sheet Processing Apparatus B>

The sheet processing apparatus B comprises a sheet drying unit 50, a relay transporting unit 60, and a sheet post-processing unit 70. The transporting unit 60 is laid on the unit 50, and the sheet post-processing unit 70 is laid on the unit 60. The upper surface of the sheet drying unit 50 serves as the sheet holding surface 42 of the second sheet-ejecting section 40*b*. In other words, the sheet post-processing unit 70 opposes the sheet drying unit 50 across the sheet holding surface 42. (Namely, the unit 70 is provided in an area that overlaps the sheet drying unit 50 in the vertical direction.) The relay transporting unit 60 is provided, also in an area overlapping the sheet drying unit 50 in the vertical direction. The sheet processing apparatus B is therefore compact as a whole, namely short in the widthwise direction.

The sheet ejecting section 59 of the sheet drying unit 50 is provided, opposing the image forming apparatus A with respect to the sheet holding surface 42, on the upper surface 51*a* of the unit housing 51. (That is, the sheet supplying port 62 of the relay transporting unit 60 is made in the lower surface 61*c* of the unit housing 61.) The direction in which the sheet is transferred from the image forming apparatus A to the sheet drying unit 50 is substantially identical to the direction in which the sheet is transferred from the relay transporting unit 60 to the sheet post-processing unit 70 (namely, the leftward direction in FIG. 2). Further, the unit housing 61 and the transport path P12 are so configured that the sheet ejecting port 63 made in the unit housing 61 of the relay transporting unit 60 is located closer to the image forming apparatus A than the sheet supplying port 62. The units 50 and 70 are therefore arranged one above the other, not side by side as in the conventional system. Hence, the installation area of the image forming system can be reduced.

The relay transporting unit 60 is arranged, opposing the image forming apparatus A across the second sheet-ejecting section 40*b*. Two sheets can therefore be delivered to the second sheet-ejecting section 40*b* from the sheet ejecting port 25 and the sheet ejecting port 64, respectively.

<Control Configuration>

Figure 3:
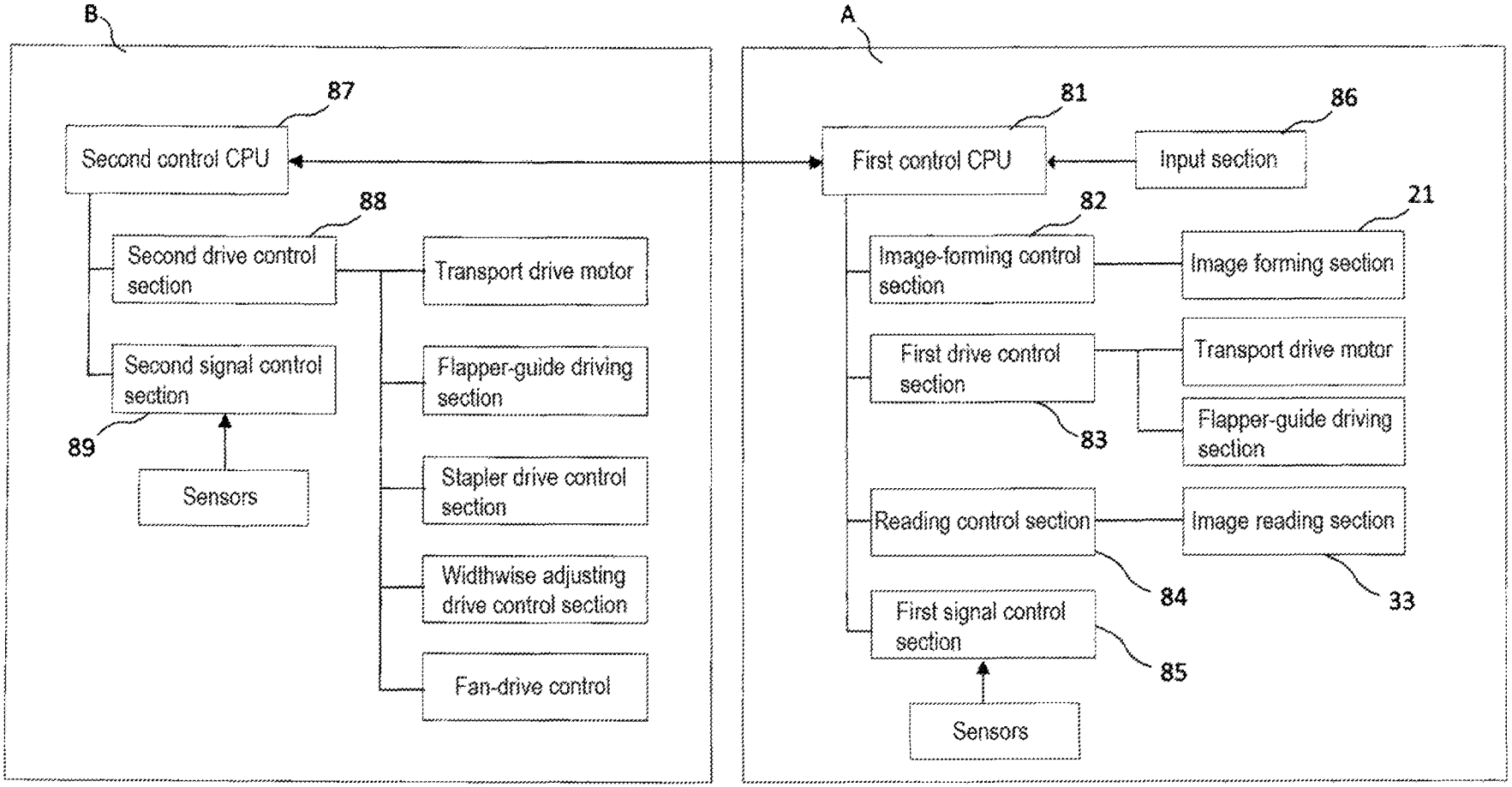
FIG. 3 is a block diagram illustrating the configuration of the control section of the embodiment.

FIG. 3 illustrates the control system incorporated in the image forming system 100 according to this embodiment. The image forming apparatus A and the sheet processing apparatus B have a control CPU 81 and a control CPU 87, respectively, and can exchange information with each other. In the image forming apparatus A, the first control CPU 81 is connected to an image-forming control section 82, a first drive control section 83, a reading control section 84, and a first signal control section 85. The first control CPU 81 receives print data from the reading control section 84 and sends the print data to the image-forming control section 82. The image-forming control section 82 controls the image forming section (printing head) 21, and the image forming section 21 forms an image. The first control CPU 81 gives an instruction to the first drive control section in accordance with the data (showing, for example, the detection of the end of a sheet) supplied from the various sensors connected to the first signal control section 85. In accordance with the input data, the first drive control section 83 controls the drive motor for the sheet transporting rollers and the flapper-guide driving section, thereby transporting the sheets. The first control CPU 81 is connected to an input section 86 for inputting information from the user, such as printing mode, sheet ejecting mode, post-processing mode, and the like, controls each control section in accordance with the information input to it, and transmits mode information to the second control CPU 87 incorporated in the sheet processing apparatus B.

In the sheet processing apparatus B, the second control CPU 87 is provided in the sheet post-processing unit 70. The second control CPU 87 controls not only the sheet post-processing unit 70, but also the sheet drying unit 50 and the relay transporting unit 60. The second control CPU 87 is connected to a second drive control section 88 and a second signal control section 89. The second control CPU 87 outputs instructions to the second drive control section 88 in accordance with the input information (detection of the end of sheet, etc.) coming from the various sensors connected to the second signal control section 89. The second drive control section 88 therefore controls the drive motor for the sheet transporting rollers and the flapper-guide driving section, thereby to transport the sheet. The second drive control section 88 is connected to a stapler-drive control section, a widthwise adjusting drive control section, and a fan-drive control section, and controls the post process and the drying process.

<Sheet Ejecting Mode>

In the image forming system 100, various sheet ejecting modes can be set. In accordance with the sheet ejecting mode set, it is determined to which sheet ejecting section the sheets should be transported. For example, four modes are available. In the first sheet ejecting mode (1), the sheet is ejected in face-up state or face-down state, with the image-formed surface turned up (if one image is printed on one side) or with the second image-formed surface turned up (if two images are printed on the two sides, respectively). In the second mode (2), the sheet is dried or not dried. In the third mode (3), the sheet is shifted or not shifted (sheet shifting direction). In the fourth mode (4), the sheet is stapled or not stapled to any other sheet (the stapling position is set, too).

Figure 4:
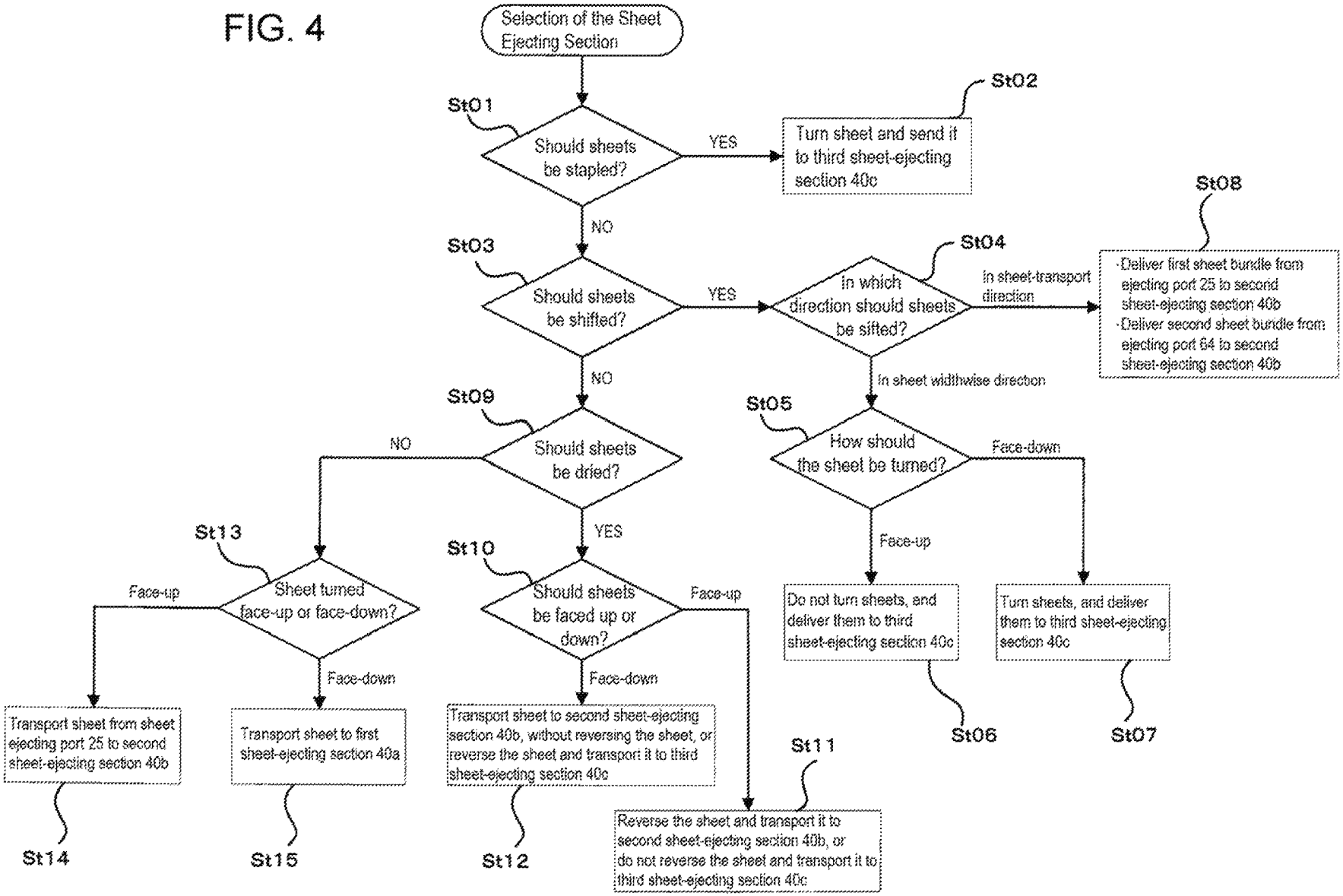
FIG. 4 is a flowchart showing how the control section selects a sheet ejecting section to which sheets should be delivered.

In the present embodiment, the transport path and the sheet ejecting section are selected to transport and eject the sheet, respectively, when the user sets the four items described above. FIG. 4 is a flowchart showing how the first control CPU 81 and the second control CPU 87 select the ejecting sections (including transport paths and sheet ejecting ports) in accordance with the data input by the user.

First, it is determined whether the sheets should be stapled together or not (St01). To staple the sheets together, it is determined that the sheets should be transferred to the third sheet-ejecting section 40*c* (ST02). The sheets will be ejected, in face-down state, onto the process tray 74, and then be stapled together. Therefore, it is determined that the sheets should be turned upside down in the sheet drying unit 50.

If the sheets need not be stapled together, it is determined whether the sheets should be shifted and then ejected (St03). To shift the sheets, it is determined in which direction the sheets should be sifted (St04). If the sheets must be shifted in their widthwise direction, it is determined whether or not the sheets should be ejected in face-up state or in face-down state (St05). If the sheets should be ejected in face-up state, the sheets are not turned upside down and are delivered to the third sheet-ejecting section 40*c* (through the transport path P11 provided in the sheet drying unit 50 (St06). If the sheets should be ejected in face-down state, it is determined that the sheets should be turned (by using the transport path P7 or the transport path P9) and should then be delivered to the third sheet-ejecting section 40*c*.

To shift the sheets in the sheet-transporting direction, the first sheet bundle S1 is ejected from the sheet ejecting port 25 to the second sheet-ejecting section 40*b*, and the second sheet bundle S2 is ejected from the sheet ejecting port 64 to the second sheet-ejecting section 40*b* (St08).

In order to eject the sheets straight, without shifting them, it is determined whether the sheets should be dried or not (St09). If the sheets should be dried, it is determined whether the sheets should be ejected in face-up state or face-down state (St10). If the sheets should be ejected in face-up state, it is determined whether they should be turned over and should then be delivered from the sheet ejecting port 64 to the second sheet-ejecting section 40*b*, or they should not be turned over and should then be delivered to the third sheet-ejecting section 40*c* (St11). If the sheets should be ejected in face-down state, it is determined whether they should not be turned over and should then be delivered from the sheet ejecting port 64 to the second sheet-ejecting section 40*b*, or they should be turned over and should then be delivered to the third sheet-ejecting section 40*c* (St12). Whether to deliver the sheets to the second sheet-ejecting section 40*b* or the third sheet-ejecting section 40*c* may be selected by the user or may be set beforehand.

Even if the sheet is not dried, it is determined whether the sheet should be ejected in face-up state or face-down state (St13). If the sheet should be ejected in face-up state, the sheet is delivered from the sheet ejecting port 25 to the second sheet-ejecting section 40*b* (St14). If the sheet should be ejected in face-down state, the sheet is delivered from the sheet ejecting port 25 to the first sheet-ejecting section 40*a* (St15).

Whether the sheet should be dried or not may be determined by the user, or may be determined by the first control CPU 81 from the character-printing ratio (i.e., amount of ink applied to the surface of the sheet), as described above. Further, the user may directly select the sheet-ejecting section to which the sheet should be delivered.

On the basis of the thus determined information about the transport paths selected (i.e., paths to be used) and the information about the sheet ejecting section to which the sheet will be delivered, the control CPUs 81 and 87 transport the sheets after image forming processing and cause the various units to perform processes (drying, turning, shifting and stapling) on the sheets and then to deliver the sheets to the sheet ejecting section selected. Therefore, the sheets can be ejected optimally in accordance with the operation mode. This can enhance the quality of the output product and can renders the image forming system 100 more user-friendly.

<Modifications>

Figure 5:
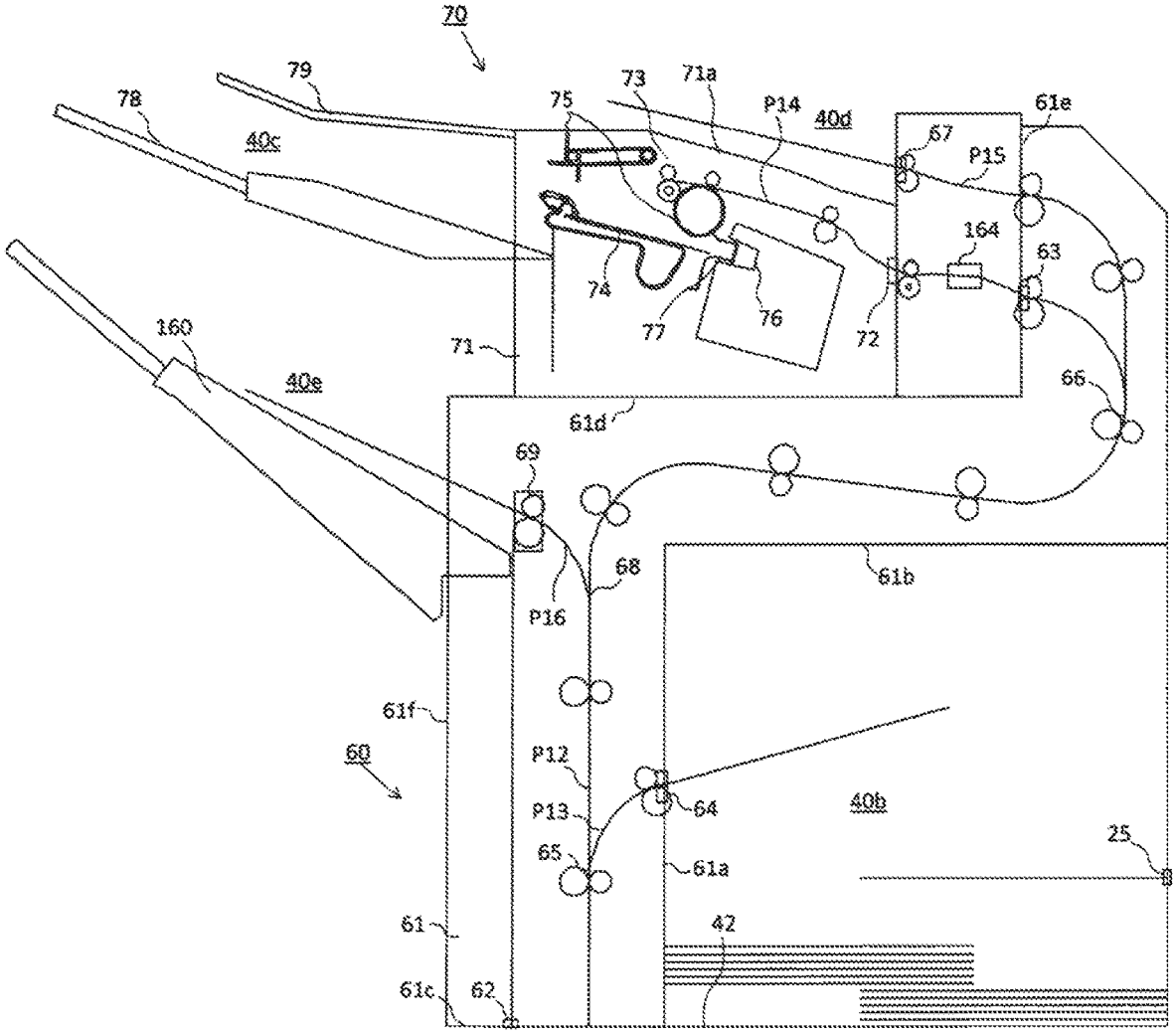
FIG. 5 illustrates a modified relay transporting unit and a modified post-processing unit.

FIG. 5 is a modification of FIG. 1, showing a modified relay transporting unit 60 and a modified sheet post-processing unit 70. Any component identical to that described above is designated by the same reference number, and will not be described repeatedly. The modified sheet post-processing unit 70 has a fourth sheet-ejecting section 40*d*, and the modified relay transporting unit 60 has a fifth sheet-ejecting section 40*e*. The fourth sheet-ejecting section 40*d* has a sheet holding surface that is the upper surface 71*a* of the unit housing 71 of the sheet post-processing unit 70. The upper surface 71*a* is shorter than the largest sheet used in the image forming system. Therefore, the sheet post-processing unit 70 has an extension tray 79 located downstream the upper surface 71*a* as viewed in the sheet ejecting direction.

The fifth sheet-ejecting section 40*e* is constituted by a stack tray 160 that can move up and down on the vertical outer face 61*f* of the unit housing 61 of the relay transporting unit 60. The stack tray 160 can move up and down for a longer stroke distance than the stack tray 78. Hence, the fifth sheet-ejecting section 40*e* is desirable for ejecting sheets in large numbers.

The relay transporting unit 60 has a path switching section 66, a transport path P15, and a sheet ejecting port 67, which serve to transport the sheet from the transport path P12 to the fourth sheet-ejecting section 40*d*. The relay transporting unit 60 further has a path switching section 68, a transport path P15, and a sheet ejecting port 69, which, similarly, serve to transport the sheet from the transport path P12 to the fifth sheet-ejecting section 40*e*.

Figure 6:
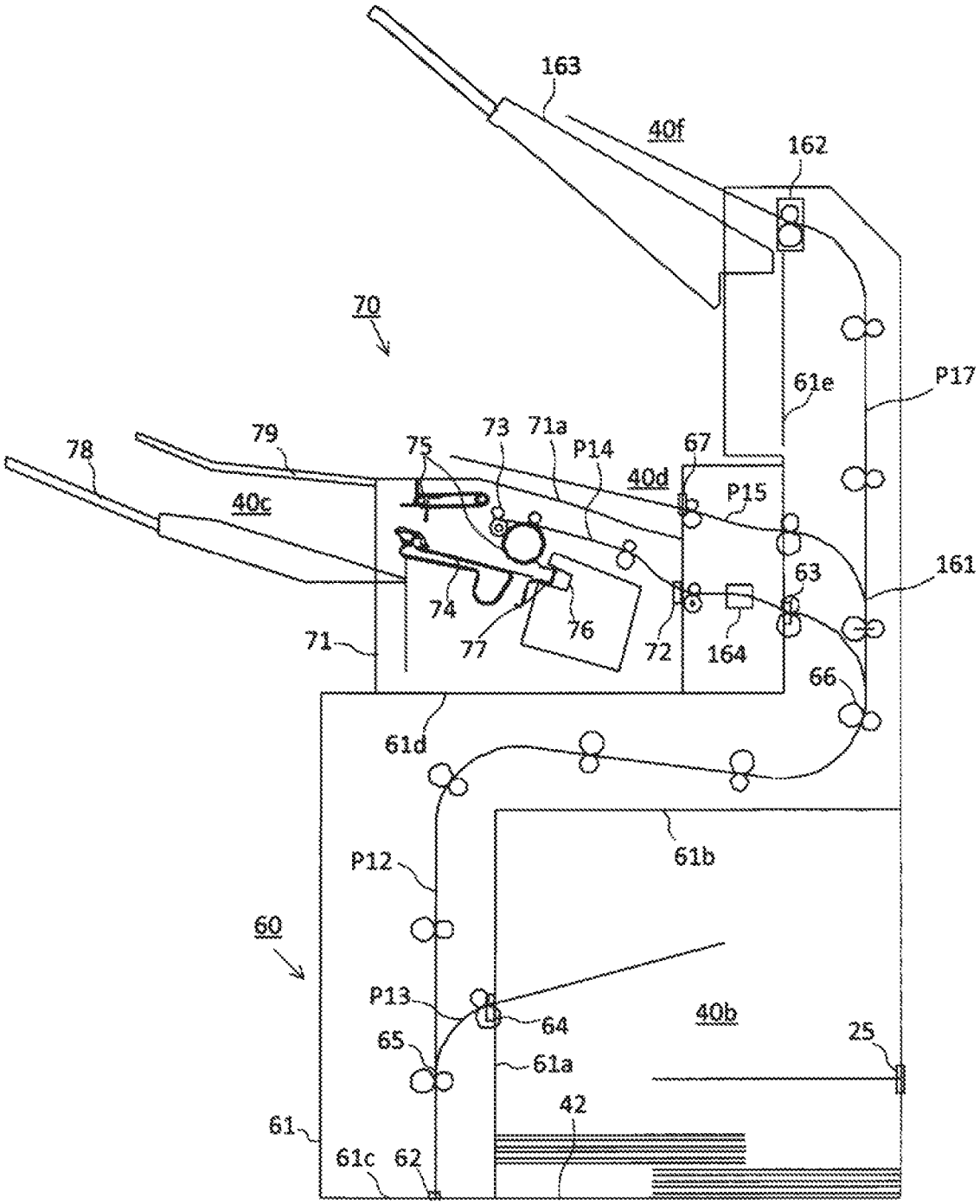
FIG. 6 illustrates another modified relay transporting unit and another modified post-processing unit.

FIG. 6 shows another modified relay transporting unit 60 and another modified sheet post-processing unit 70. Any component identical to that described above is designated by the same reference number, and will not be described repeatedly. As in the relay transporting unit shown in FIG. 5, the fourth sheet-ejecting section 40*d* is located above the sheet post-processing unit 70, the transport path P15 branches from the transport path P12, and the sheet is ejected onto the sheet holding surface 71*a* and the extension tray 79. A sixth sheet-ejecting section 40*f* is arranged above the fifth sheet-ejecting section 40*e*. A path switching section 161, a transport path P17, and a sheet ejecting port 162 are provided to transport the sheet from the transport path P15 of the relay transporting unit 60 to the sixth sheet-ejecting section 40*f*. The housing 61 of the relay transporting unit 60 extends above the sheet ejecting port 63 shown in FIG. 1, and has a sheet ejecting port 162 in the upper part. A stack tray 163 is provided, able to move up and down in the area into which the housing 61 extends. (The stack tray 163 can move up and down between the two positions indicated a solid line and a broken line, respectively.) The stack tray 163 can hold more sheets than the stack tray 78 of the sheet post-processing unit 70.

The fourth to sixth sheet ejecting sections may have a shifting function (for example, widthwise adjusting members may be provided or the sheet transporting rollers provided at the sheet ejecting ports may be moved in the sheet widthwise direction, thereby to shift and eject the sheet). If the sheets are not stapled and need to be shifted and ejected in the sheet widthwise direction, the fourth to sixth sheet ejecting sections may be selected and used. Further, a relay transporting unit may be provided, as shown in FIGS. 5 and 6, between the sheet ejecting port 63 of the relay transporting unit 60 and the sheet supplying port 72 of the sheet post-processing unit 70. Moreover, the relay transporting unit 60 may incorporate a punching unit 164 configured to punch the sheets.

This application is based upon and claims the benefit of priority from the prior Japanese Patent Application No. 2017-250294, the entire contents of which are incorporated herein by reference.

What is claimed is:

1. An image forming system comprising:

an image forming unit configured to perform an image forming process on a medium;

a medium ejecting section having a holding part onto which the medium having an image formed in the image forming unit may be ejected;

a first process unit provided below the holding part and configured to perform a prescribed process on the medium;

a second process unit provided above the holding part and configured to perform a prescribed process on the medium; and a relay transporting unit which has a relay transport path for transporting the medium from the first process unit to the second process unit, wherein a medium receiving port through which the relay transporting unit receives the medium from the first process unit is provided, opposing a medium ejecting port through which the medium is ejected from the image forming unit onto the holding part across the holding part.

2. The image forming system according to claim 1, wherein the holding part holds the medium transported from the image forming unit and/or the medium transported from the first process unit.

3. The image forming system according to claim 1, wherein the relay transporting unit has a second medium ejecting port for ejecting the medium to the holding part from the side opposite to the medium ejecting port.

4. The image forming system according to claim 1, wherein a direction in which the medium is delivered from the image forming unit to the medium ejecting section is substantially identical to a direction in which the medium is transferred from the relay transporting unit to the second process unit.

5. The image forming system according to claim 1, wherein the relay transport path is bent, first upward from the medium receiving port, then toward the image forming unit, and further upward, and reaches a medium transfer port.

6. The image forming system according to claim 1, wherein the relay transport path is arranged, surrounding the holding part on which the medium processed in the image forming unit is mounted.

7. The image forming system according to claim 1, wherein the relay transporting unit has a unit housing which extends upward from an upper surface of the first process unit and which is bent toward the image forming unit, and the first process unit is provided under the unit housing of the relay transporting unit.

8. The image forming system according to claim 1, wherein a unit housing of the relay transporting unit is arranged, surrounding the holding part.

9. The image forming system according to claim 1, wherein the holding part, the relay transporting unit, and the second process unit are arranged, overlapping an upper surface of the first process unit, as viewed in a vertical direction.

10. The image forming system according to claim 1, wherein the first process unit is a medium reversing unit configured to turn the medium upside down after an image has been formed on the medium in the image forming unit.

11. The image forming system according to claim 1, wherein the second process unit is a post-processing unit configured to perform any one of the processes including stapling, punching, shifting and ejecting sheets on the medium processed in the image forming unit.

12. An image forming system comprising:

an image forming unit configured to perform an image forming process on a medium;

a medium ejecting section having a holding part onto which the medium having an image formed in the image forming unit may be ejected;

a first process unit provided below the holding part and configured to perform a prescribed process on the medium; and a second process unit provided above the holding part and configured to perform a prescribed process on the medium, wherein the first process unit is a medium drying unit configured to perform a drying process on the medium having an image formed in the image forming unit.

13. The image forming system according to claim 12, further comprising:

a relay transporting unit which has a relay transport path for transporting the medium from the first process unit to the second process unit.

14. The image forming system according to claim 13, wherein a medium receiving port through which the relay transporting unit receives the medium from the first process unit is provided, opposing a medium ejecting port through which the medium is ejected from the image forming unit onto the holding part across the holding part.

* * * * *